US011315710B2

(12) United States Patent
Hirota et al.

(10) Patent No.: US 11,315,710 B2
(45) Date of Patent: *Apr. 26, 2022

(54) R-FE-B SINTERED MAGNET AND MAKING METHOD

(71) Applicant: Shin-Etsu Chemical Co., Ltd., Tokyo (JP)

(72) Inventors: Koichi Hirota, Echizen (JP); Tetsuya Kume, Echizen (JP); Masayuki Kamata, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 510 days.

This patent is subject to a terminal disclaimer.

(21) Appl. No.: 15/617,510

(22) Filed: Jun. 8, 2017

(65) Prior Publication Data

US 2017/0365384 A1 Dec. 21, 2017

(30) Foreign Application Priority Data

Jun. 20, 2016 (JP) ..... JP2016-121539

(51) Int. Cl.
*H01F 1/059* (2006.01)
*B22F 3/16* (2006.01)
(Continued)

(52) U.S. Cl.
CPC ..... *H01F 1/059* (2013.01); *B22F 3/16* (2013.01); *B22F 3/24* (2013.01); *C21D 6/007* (2013.01);
(Continued)

(58) Field of Classification Search
CPC ..... H01F 41/0266; H01F 1/059; H01F 1/017; H01F 1/0577; H01F 41/0273; H01F 7/02;
(Continued)

(56) References Cited

U.S. PATENT DOCUMENTS 4,826,546 A 5/1989 Yamamoto et al.
7,090,730 B2 8/2006 Nomura et al.
(Continued)

FOREIGN PATENT DOCUMENTS

CN 105960690 A 9/2016
CN 106024252 A 10/2016
(Continued)

OTHER PUBLICATIONS

Li et al., Role of amorphous grain boundaries in nanocomposite NdFeB permanent magnets, Journal of Applied Physics 92, p. 7514-7518 (Year: 2002).*
(Continued)

*Primary Examiner* — Holly Rickman
*Assistant Examiner* — Linda N Chau
(74) *Attorney, Agent, or Firm* — WHDA, LLP

(57) ABSTRACT

An R—Fe—B base sintered magnet is provided consisting essentially of R (which is at least two rare earth elements and essentially contains Nd and Pr), $M_1$ which is at least two of Si, Al, Mn, Ni, Cu, Zn, Ga, Ge, Pd, Ag, Cd, In, Sn, Sb, Pt, Au, Hg, Pb, and Bi, $M_2$ which is at least one of Ti, V, Cr, Zr, Nb, Mo, Hf, Ta, and W, boron, and the balance of Fe, and containing an intermetallic compound $R_2(Fe,(Co))_{14}B$ as a main phase. The magnet contains an R—Fe(Co)-$M_1$ phase as a grain boundary phase, the R—Fe(Co)-$M_1$ phase contains A phase which is crystalline with crystallites of at least 10 nm formed at grain boundary triple junctions, and B phase which is amorphous and/or nanocrystalline with crystallites of less than 10 nm formed at intergranular grain boundaries and optionally grain boundary triple junctions.

8 Claims, 4 Drawing Sheets

(51) Int. Cl.

| | |
|---|---|
| ***B22F 3/24*** | (2006.01) |
| ***H01F 41/00*** | (2006.01) |
| ***H01F 41/02*** | (2006.01) |
| ***C22C 38/16*** | (2006.01) |
| ***C22C 38/14*** | (2006.01) |
| ***C22C 38/10*** | (2006.01) |
| ***C22C 38/06*** | (2006.01) |
| ***C22C 38/02*** | (2006.01) |
| ***C22C 38/00*** | (2006.01) |
| ***C21D 6/00*** | (2006.01) |
| ***H01F 1/057*** | (2006.01) |

(52) U.S. Cl.

CPC ..... *C21D 6/008* (2013.01); *C22C 38/002* (2013.01); *C22C 38/005* (2013.01); *C22C 38/008* (2013.01); *C22C 38/02* (2013.01); *C22C 38/06* (2013.01); *C22C 38/10* (2013.01); *C22C 38/14* (2013.01); *C22C 38/16* (2013.01); *H01F 1/0577* (2013.01); *H01F 41/0266* (2013.01); *H01F 41/0273* (2013.01); *B22F 2003/248* (2013.01); *B22F 2301/355* (2013.01); *C21D 2201/03* (2013.01)

(58) Field of Classification Search

CPC ..... B22F 2003/248; B22F 2301/355; B22F 3/16; B22F 3/24; C21D 2201/03; C21D 6/007; C21D 6/008; C22C 38/002; C22C 38/005; C22C 38/008; C22C 38/02; C22C 38/06; C22C 38/10; C22C 38/14; C22C 38/16

See application file for complete search history.

(56) References Cited

U.S. PATENT DOCUMENTS

| | | | | |
|---|---|---|---|---|
| 9,892,831 | B2 | 2/2018 | Hirota et al. | |
| 10,410,775 | B2 | 9/2019 | Hirota et al. | |
| 2004/0094237 | A1 | 5/2004 | Nomura et al. | |
| 2010/0182113 | A1 | 7/2010 | Yoshimura et al. | |
| 2011/0000586 | A1 | 1/2011 | Nomura et al. | |
| 2012/0235778 | A1* | 9/2012 | Kunieda | H01F 1/0577 335/302 |
| 2013/0009503 | A1 | 1/2013 | Iwasaki et al. | |
| 2013/0092868 | A1* | 4/2013 | Nakajima | C22C 38/005 252/62.51 R |
| 2013/0271248 | A1 | 10/2013 | Nagata et al. | |
| 2013/0293328 | A1 | 11/2013 | Kuniyoshi | |
| 2014/0132377 | A1 | 5/2014 | Nakajima et al. | |
| 2014/0191831 | A1 | 7/2014 | Yamazaki et al. | |
| 2014/0290803 | A1 | 10/2014 | Kato et al. | |
| 2016/0042848 | A1 | 2/2016 | Kuniyoshi et al. | |
| 2016/0293303 | A1 | 10/2016 | Hirota et al. | |
| 2016/0293304 | A1 | 10/2016 | Hirota et al. | |
| 2016/0293307 | A1 | 10/2016 | Hirota et al. | |
| 2016/0300648 | A1 | 10/2016 | Nagata et al. | |
| 2017/0018342 | A1* | 1/2017 | Fukagawa | C22C 38/30 |
| 2017/0140856 | A1 | 5/2017 | Hirota et al. | |
| 2017/0256344 | A1 | 9/2017 | Satoh et al. | |
| 2017/0365384 | A1 | 12/2017 | Hirota et al. | |
| 2018/0090249 | A1 | 3/2018 | Ohashi et al. | |
| 2018/0090250 | A1 | 3/2018 | Ohashi et al. | |

FOREIGN PATENT DOCUMENTS

| | | | |
|---|---|---|---|
| DE | 19945942 | A1 | 4/2001 |
| EP | 0945878 | A1 | 9/1999 |
| EP | 1 214 720 | A1 | 6/2002 |
| EP | 1 420 418 | A1 | 5/2004 |
| EP | 1 214 720 | B1 | 3/2005 |
| EP | 1 420 418 | B1 | 10/2006 |
| EP | 2 500 915 | A1 | 9/2012 |
| EP | 2 555 208 | A1 | 2/2013 |
| EP | 2 590 181 | A1 | 5/2013 |
| JP | H07-240308 | A | 9/1995 |
| JP | 2003-510467 | A | 3/2003 |
| JP | 3997413 | A | 10/2007 |
| JP | 2011-211071 | A | 10/2011 |
| JP | 2014-132628 | A | 7/2014 |
| JP | 2014-146788 | A | 8/2014 |
| JP | 5572673 | B2 | 8/2014 |
| JP | 2014-209546 | A | 11/2014 |
| KR | 2010-0097580 | A | 9/2010 |
| WO | 2014/157448 | A1 | 10/2014 |
| WO | 2014/157451 | A | 10/2014 |
| WO | 2016/043039 | A1 | 3/2016 |

OTHER PUBLICATIONS

Extended European Search Report dated Dec. 1, 2017, issued in counterpart European Application No. 17175355.1. (12 pages).

Office Action dated Dec. 17, 2019, issued in counterpart JP Application No. 2017-109597, with English translation. (6 pages).

Final Office Action dated Oct. 31, 2019, issued in U.S. Appl. No. 15/710,341. (53 pages).

Office Action dated Nov. 13, 2018, issued in JP Application No. 2016-064942 counterpart to co-pending U.S. Appl. No. 15/087,241, with machine translation. (6 pages).

Extended European Search Report dated Aug. 4, 2016, issued in EP Application No. 16163097.5 counterpart to co-pending U.S. Appl. No. 15/087,241. (8 pages).

Kyoung-Hoon Bae et al., "Effect of WS2/Al co-doping on microstructural and magnetic properties of Nd-Fe-B sintered magnets", Journal of Alloys and Compounds, vol. 673, pp. 321-326, 2016, cited in co-pending U.S. Appl. No. 15/087,108. (6 pages).

Office Action dated Nov. 13, 2018, issued in JP Application No. 2016-064966 counterpart to co-pending U.S. Appl. No. 15/087,108, with machine translation. (6 pages).

Non-Office Action dated Sep. 5, 2018, issued in co-pending U.S. Appl. No. 15/087,241. (23 pages).

Non-Office Action dated Jan. 18, 2019, issued in co-pending U.S. Appl. No. 15/087,241. (9 pages).

Non-Office Action dated Dec. 22, 2017, issued in co-pending U.S. Appl. No. 15/087,108. (15 pages).

Non-Office Action dated Mar. 27, 2019, issued in co-pending U.S. Appl. No. 15/087,108. (11 pages).

Non-Final Office Action dated May 31, 2019, issued in U.S. Appl. No. 15/710,341. (28 pages).

Extended European Search Report dated Mar. 15, 2018, issued in counterpart European U.S. Appl. No. 17/192,327.9. (7 pages).

Notice of Allowance dated Aug. 21, 2019, issued in U.S. Appl. No. 15/087,108. (9 pages).

Notice of Allowance dated Oct. 30, 2017, issued in U.S. Appl. No. 15/087,179. (17 pages).

Office Action dated Aug. 20, 2019, issued in CN Application No. 201611027396.4 (counterpart to U.S. Appl. No. 15/350,327), with English translation. (33 pages).

Non-Final Office Action dated Mar. 14, 2019, issued in U.S. Appl. No. 15/350,327. (15 pages).

* cited by examiner

R-FE-B SINTERED MAGNET AND MAKING METHOD

CROSS-REFERENCE TO RELATED APPLICATION

This non-provisional application claims priority under 35 U.S.C. §119(a) on Patent Application No. 2016-121539 filed in Japan on Jun. 20, 2016, the entire contents of which are hereby incorporated by reference.

TECHNICAL FIELD

This invention relates to an R—Fe—B base sintered magnet having a high coercivity at elevated temperature and a method for preparing the same.

BACKGROUND ART

While Nd—Fe—B sintered magnets, referred to as Nd magnets, hereinafter, are regarded as the functional material necessary for energy saving and performance improvement, their application range and production volume are expanding every year. Since the automotive application assumes service in a hot environment, the Nd magnets incorporated in driving motors and power steering motors in hybrid vehicles and electric vehicles must have high coercivity as well as high remanence at elevated temperature. The Nd magnets, however, tend to experience a substantial drop of coercivity at elevated temperature. Then the coercivity at room temperature must be preset fully high in order to insure an acceptable coercivity at service temperature.

As the means for increasing the coercivity of Nd magnets, it is effective to substitute Dy or Tb for part of Nd in $Nd_2Fe_{14}B$ compound as main phase. For these elements, there are short reserves, the mining areas amenable to commercial operation are limited, and geopolitical risks are involved. These factors indicate the risk that the price is unstable or largely fluctuates. Under the circumstances, in order that R—Fe—B magnets adapted for high-temperature service find a wider market, a new approach or magnet composition capable of increasing coercivity while minimizing the content of Dy and Tb is needed.

From this standpoint, several methods are already proposed. Patent Document 1 discloses an R—Fe—B base sintered magnet consisting essentially of 12-17 al % of R (wherein R stands for at least two of yttrium and rare earth elements and essentially contains Nd and Pr), 0.1-3 at % of Si, 5-5.9 at % of boron, 0-10 at % of Co, and the balance of Fe (with the proviso that up to 3 at % of Fe may be substituted by at least one element selected from among Al, Ti, V, Cr, Mn, Ni, Cu, Zn, Ga, Ge, Zr, Nb, Mo, In, Sn, Sb, Hf, Ta, W, Pt, Au, Hg, Pb, and Bi), containing an intermetallic compound $R_2(Fe,(Co),Si)_{14}B$ as main phase, and exhibiting a coercivity of at least 10 kOe. Further, the magnet is free of a boron-rich phase and contains at least 1 vol % based on the entire magnet of an R—Fe(Co)—Si grain boundary phase consisting essentially of 25-35 at % of R, 2-8 at % of Si, up to 8 at % of Co, and the balance of Fe. After sintering or heat treatment following sintering, the sintered magnet is cooled at a rate of 0.1 to 5° C./min at least in a temperature range from 700° C. to 500° C., or cooled in multiple stages including holding at a certain temperature for at least 30 minutes on the way of cooling, for thereby generating the R—Fe(Co)—Si grain boundary phase.

Patent Document 2 discloses a Nd—Fe—B alloy with a low boron content. A sintered magnet is prepared by sintering the alloy and cooling the sintered product below 300° C. The step of cooling down to 800° C. is at an average cooling rate $\Delta T1/\Delta t1<5K/min$.

Patent Document 3 discloses an R-T-B magnet comprising a main phase of $R_2Fe_{14}B$ and some grain boundary phases. A one of the grain boundary phases is an R-rich phase containing more R than the main phase, and another is a transition metal-rich phase having a lower rare earth concentration and a higher transition metal concentration than the main phase. The R-T-B rare earth sintered magnet is prepared by sintering at 800 to 1,200° C. and heat treatment at 400 to 800° C.

Patent Document 4 discloses an R-T-B rare earth sintered magnet comprising a grain boundary phase containing an R-rich phase having a total atomic concentration of rare earth elements of at least 70 at % and a ferromagnetic transition metal-rich phase having a total atomic concentration of rare earth elements of 25 to 35 at %, wherein an area proportion of the transition metal-rich phase is at least 40% of the grain boundary phase. The sintered magnet is prepared by shaping an allay material into a compact, sintering the compact at 800 to 1,200° C., and a plurality of heat treatments, i.e., first heat treatment of heating at a temperature of 650 to 900° C., cooling to 200° C. or below, and second heat treatment of heating at 450 to 600° C.

Patent Document 5 discloses an R-T-B rare earth sintered magnet comprising a main phase of $R_2Fe_{14}B$ and a grain boundary phase containing more R than the main phase, wherein the main phase of $R_2Fe_{14}B$ has an axis of easy magnetization parallel to c-axis, crystal grains of the main phase are of elliptic shape elongated in a direction perpendicular to the c-axis, and the grain boundary phase contains an R-rich phase having a total atomic concentration of rare earth elements of at least 70 at % and a transition metal-rich phase having a total atomic concentration of rare earth elements of 25 to 35 at %. Also described are sintering at 800 to 1,200° C. and subsequent heat treatment at 400 to 800° C. in an argon atmosphere.

Patent Document 6 discloses a rare earth magnet comprising a main phase of $R_2T_{14}B$ crystal grains and an intergranular grain boundary phase between two adjacent $R_2T_{14}B$ main phase crystal grains, wherein the intergranular grain boundary phase has a thickness of 5 nm to 500 nm and is composed of a phase having different magnetism from ferromagnetism. The intergranular grain boundary phase is formed of a compound which contains element T, but does not become ferromagnetic. Thus, the intergranular grain boundary phase contains a transition metal element and element M such as Al, Ge, Si, Sn or Ga. By further adding Cu to the rare earth magnet, a crystalline phase with a $La_6Co_{11}Ga_3$-type crystal structure may be evenly and broadly formed as the intergranular grain boundary phase, and a thin R—Cu layer may be formed at the interface between the $La_6Co_{11}Ga_3$-type intergranular grain boundary phase and the $R_2T_{14}B$ main phase crystal grains. As a result, the interface of the main phase can be passivated, the generation of strain due to a lattice mismatch be suppressed, and reverse magnetic domain-generating nuclei be inhibited. The method of preparing the magnet involves sintering, heat treatment at a temperature of 500 to 900° C. and cooling at a cooling rate of at least 100° C./min, especially at least 300° C./min.

Patent Documents 7 and 8 disclose an R-T-B sintered magnet comprising a main phase of $Nd_2Fe_{14}B$ compound and an intergranular grain boundary phase between two main phase grains, with a thickness of 5 to 30 nm, and having a grain boundary triple junction surrounded by three or more main phase grains.

CITATION LIST

Patent Document 1: JP 3997413 (U.S. Pat. No. 7,090,730, EP 1420418)
Patent Document 2: JP-A 2003-510467 (EP 1214720)
Patent Document 3: JP 5572673 (US 20140132377)
Patent Document 4: JP-A 2014-132628
Patent Document 5: JP-A 2014-146788 (US 20140191831)
Patent Document 6: JP-A 2014-209546 (US 20140290803)
Patent Document 7: WO 2014/157448
Patent Document 8: WO 2014/157451

DISCLOSURE OF INVENTION

Under the circumstances discussed above, there exists a need for an R—Fe—B base sintered magnet which exhibits a high coercivity even at elevated temperature despite a minimal or no content of Dy, Tb and Ho.

An object of the invention is to provide a novel R—Fe—B base sintered magnet exhibiting a high coercivity even at elevated temperature, and a method for preparing the same.

The inventors have found that the R—Fe—B sintered magnet defined below exhibits a high coercivity even at elevated temperature; and that the desired magnet can be prepared by the method defined below.

In one aspect, the invention provides an R—Fe—B base sintered magnet of a composition consisting essentially of 12 to 17 at % of R which is at least two of yttrium and rare earth elements and essentially contains Nd and Pr, 0.1 to 3 at % of $M_1$ which is at least two elements selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.5+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, and containing an intermetallic compound $R_2(Fe,(Co))_{14}B$ as a main phase. The magnet contains an R—Fe(Co)-$M_1$ phase consisting essentially of 25 to 35 at % of R, 2 to 8 at % of $M_1$, up to 8 at % of Co, and the balance of Fe as a grain boundary phase. The R—Fe(Co)-$M_1$ phase contains an A phase which is crystalline with crystallites having a grain size of at least 10 nm formed at grain boundary triple junctions, and a B phase which is amorphous and/or nanocrystalline with crystallites having a grain size of less than 10 nm formed at intergranular grain boundaries or intergranular grain boundaries and grain boundary triple junctions, the B phase having a different composition from the A phase.

In a preferred embodiment, a total content of Dy, Tb and Ho is up to 5 at % of the total of R.

Preferably, in the A phase, $M_1$ consists of 20 to 80 at % of at least one element selected from the group consisting of Si, Ge, In, Sn, and Pb and the balance of at least one element selected from the group consisting of Al, Mn, Ni, Cu, Zn, Ga, Pd, Ag, Cd, Sb, Pt, Au, Hg and Bi.

Preferably, in the B phase, $M_1$ consists of more than 80 at % of at least one element selected from the group consisting of Si, Al, Ga, Ag, and Cu and the balance of at least one element selected from the group consisting of Mn, Ni, Zn, Ge, Pd, Cd, In, Sn, Sb, Pt, Au, Hg, Pb and Bi.

In a preferred embodiment, the grain boundary phase containing the R—Fe(Co)-$M_1$ phase containing the A phase and B phase is distributed such as to surround individual crystal grains of the main phase at intergranular grain boundaries and grain boundary triple junctions. More preferably, the narrowest portion of the grain boundary phase interposed between two adjacent crystal grains of the main phase has an average thickness of at least 50 nm.

In another aspect, the invention provides a method for preparing the R—Fe—B base sintered magnet defined above, comprising the steps of:

providing an alloy fine powder having a predetermined composition, compression shaping the alloy fine powder in an applied magnetic field into a compact, sintering the compact at a temperature of 900 to 1,250° C. into a sintered body, high-temperature aging treatment including cooling the sintered body to a temperature of 400° C. or below, heating the sintered body at a temperature in the range of 700 to 1,000° C. and not higher than the peritectic point of the A phase, and cooling again to a temperature of 400° C. or below at a rate of 5 to 100° C./ruin, or high-temperature aging treatment including lowering, holding or elevating the temperature of the sintered body for thereby heating it at a temperature in the range of 700 to 1,000° C. and not higher than the peritectic point of the A phase, and cooling to a temperature of 400° C. or below at a rate of 5 to 100° C./min, and low-temperature aging treatment including heating the sintered body, after the high-temperature aging treatment, at a temperature in the range of 400 to 600° C. and cooling to a temperature of 200° C. or below.

Preferably, the A phase is formed at grain boundary triple junctions during the high-temperature aging treatment, and the B phase is formed at intergranular grain boundaries or intergranular grain boundaries and grain boundary triple junctions during the low-temperature aging treatment.

Advantageous Effects of Invention

The R—Fe—B base sintered magnet of the invention exhibits a high coercivity even at elevated temperature. It gives high performance as a rare earth permanent magnet to be mounted in temperature service equipment.

Notably, room temperature is often abbreviated as RT.

DESCRIPTION OF PREFERRED EMBODIMENTS

Figure 1:
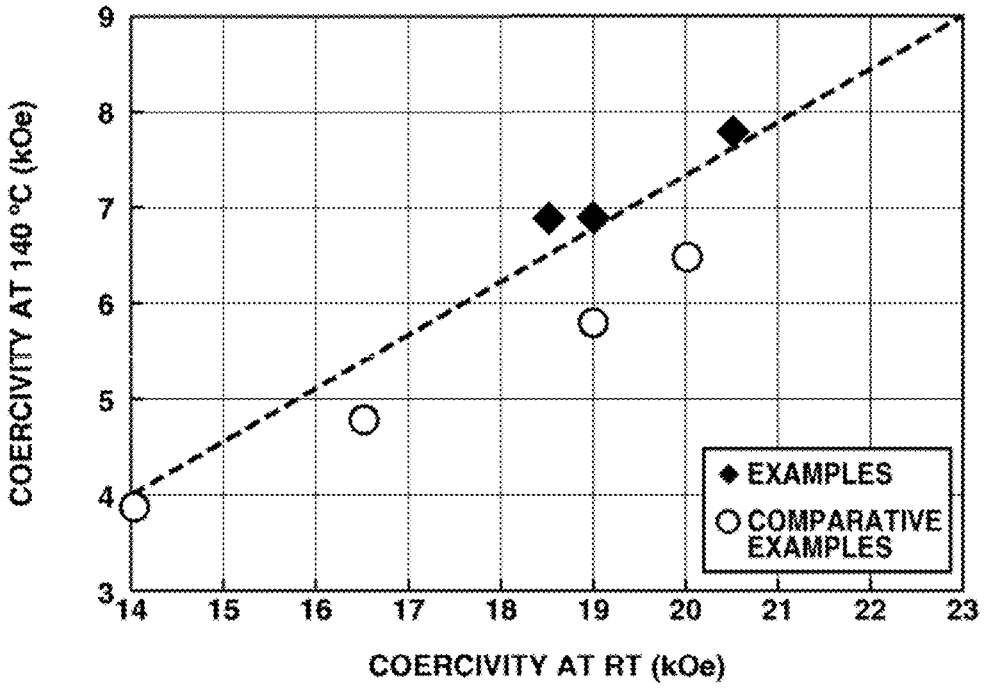
FIG. 1 is a diagram showing coercivity values at RT and 140° C. of magnets of Examples 1 to 4 and Comparative Examples 1 to 4.

First, the composition of the R—Fe—B base sintered magnet is described. The magnet has a composition (expressed in atomic percent) consisting essentially of 12 to 17 at % of R, 0.1 to 3 at % of $M_1$, 0.05 to 0.5 at % of $M_2$, 4.5+2×m to 5.9+2×m at % of B (boron) wherein m is at % of $M_2$, up to 10 at % of Co (cobalt), up to 0.5 at % of C (carbon), up to 1.5 at % of O (oxygen), up to 0.5 at % of N (nitrogen), and the balance of Fe (iron) and incidental impurities.

Herein, R is at least two of yttrium and rare earth elements and essentially contains neodymium (Nd) and praseodymium (Pr). The preferred rare earth elements other than Nd and Pr include La, Ce, Gd, Tb, Dy and Ho. The content of R is 12 to 17 at %, preferably at least 13 at % and up to 16 at % based on the overall magnet composition excluding incidental impurities. If the content of R is less than 12 at %, the magnet has an extremely reduced coercivity. If the content of R exceeds 17 at %, the magnet has a low remanence (residual magnetic flux density) Br. Preferably essential elements Nd and Pr in total account for 80 to 100 at % based on the total of R. R may or may not contain Dy, Tb and Ho. When R contains Dy, Tb and/or Ho, the total content of Dy, Tb and Ho is preferably up to 5 at %, more preferably up to 4 at %, even more preferably up to 2 at %, and most preferably up to 1.5 at %, based on the total of R.

$M_1$ is at least two elements selected from the group consisting of Si, Al, Mn, Ni, Cu, Zn, Ga, Ge, Pd, Ag, Cd, In, Sn, Sb, Pt, Au, Hg, Pb, and Bi. $M_1$ is an element necessary to form the R—Fe(Co)-$M_1$ phase to be described later. The inclusion of the predetermined content of $M_1$ ensures to form the R—Fe(CO)-$M_1$ phase. When no $M_1$ element is added, or when only one $M_1$ element is added, the R—Fe (Co)-$M_1$ phase is not formed as a combination of two or more phases of different crystallinity, failing to obtain the desired magnetic properties. For this reason, $M_1$ should be composed of two or more elements. The content of $M_1$ is 0.1 to 3 at %, preferably at least 0.5 at % and up to 2.5 at % based on the overall magnet composition excluding incidental impurities. If the content of $M_1$ is less than 0.1 at %, the R—Fe(Co)-$M_1$ phase is present in the grain boundary phase in too low proportion to improve coercivity. If the content of $M_1$ is more than 3 at %, the magnet has poor squareness and a low remanence (Br).

$M_2$ is at least one element selected from the group consisting of Ti, V, Cr, Zr, Nb, Mo, Hf, Ta and W. $M_2$ capable of forming a stable boride in a grain boundary is added for the purpose of inhibiting growth of abnormal grains during sintering. The content of $M_2$ is 0.05 to 0.5 at % based on the overall magnet composition excluding incidental impurities. The addition of M enables sintering at relatively high temperature during magnet preparation, leading to improvements in squareness and magnetic properties.

The content of boron (B) is (4.5+2×m) to (5.9+2×m) at %, preferably at least (4.6+2×m) at % and up to (5.7+2×m) at %, based on the overall magnet composition excluding incidental impurities, wherein m is a content (at %) of $M_2$. Differently stated, since the content of $M_2$ element in the magnet composition is in the range of 0.05 to 0.5 at %, the range of B content varies with a particular content of $M_2$ element in this range. Specifically the content of B is from 4.6 at % to 6.9 at %, more specifically at least 4.7 at % and up to 6.7 at %, based on the overall magnet composition excluding incidental impurities. In particular, the upper limit of B content is crucial. If the B content exceeds (5.9+2×m) at %, the R—Fe(Co)-$M_1$ phase is not formed at the grain boundary, and instead, an $R_{1.1}Fe_4B_4$ compound phase, which is so-called B-rich phase, is formed. If the B-rich phase is present in the magnet, the coercivity of the magnet is not fully increased. If the B content is less than (4.5+2×m) at %, the percent volume of the main phase is reduced, and magnetic properties are degraded.

Cobalt (Co) is optional. For the purpose of improving Curie temperature and corrosion resistance, Co may substitute for part of Fe. When Co is contained, the Co content is preferably up to 10 at %, more preferably up to 5 at % based on the overall magnet composition excluding incidental impurities. A Co content in excess of 10 at % is undesirable because of a substantial loss of coercivity. More preferably the Co content is up to 10 at %, especially up to 5 at % based on the total of Fe and Co. The expression "Fe,(Co)" or "Fe(Co)" is used to indicate two cases where cobalt is contained and not contained.

The contents of oxygen, carbon and nitrogen are desirably as low as possible and more desirably nil. However, such elements are inevitably introduced during the magnet preparation process. A carbon content of up to 0.5 at %, especially up to 0.4 at %, an oxygen content of up to 1.5 at %, especially up to 1.2 at %, and a nitrogen content of up to 0.5 at %, especially up to 0.3 at %, based on the overall magnet composition excluding incidental impurities, are permissible.

The balance is iron (Fe). The Fe content is preferably at least 70 at %, more preferably at least 75 at % and up to 80 at % based on the overall magnet composition excluding incidental impurities.

It is permissible that the magnet contains other elements such as H, F, Mg, P, S, Cl and Ca as the incidental impurity in an amount of up to 0.1% by weight based on the total weight of constituent elements and impurities. The content of incidental impurities is desirably as low as possible.

The R—Fe—B base sintered magnet has an average crystal grain size of up to 6 μm, preferably up to 5.5 μm, and more preferably up to 5 and at least 1.5 μm, preferably at least 2 μm. The average grain size of the sintered body may be controlled by adjusting the average particle size of alloy powder during fine milling. Also the alignment of c-axis which is an axis of easy magnetization of $R_2Fe_{14}B$ grains is preferably at least 98%. An alignment of less than 98% may lead to a decline of remanence (Br).

Preferably the R—Fe—B base sintered magnet has a remanence (Br) of at least 11 kG (1.1 T), more preferably at least 11.5 kG (1.15 T), and even more preferably at least 12 kG (1.2 T) at RT (~23° C.).

Also preferably the R—Fe—B base sintered magnet has a coercivity of at least 10 kOe (796 kA/m), more preferably at least 14 kOe (1,114 kA/m), and even more preferably at least 16 kOe (1,274 kA/m) at RT (~23° C.). In general, a temperature coefficient of coercivity (β) (%/° C.) is computed according to the formula (1):

$$\beta=(Hcj_{140}-Hcj_{RT})/\Delta T/Hcj_{RT}\times 100 \quad (1)$$

wherein $Hcj_{140}$ is a coercivity at 140° C., $Hcj_{RT}$ is a coercivity at RT, and ΔT is a variation of temperature from RT to 140° C. According to the invention, there is available an R—Fe—B sintered magnet having a value of temperature coefficient of coercivity (β), as computed from formula (1), which is higher than the value which is computed from the formula (2) for computing a temperature coefficient from the coercivity at RT of a conventional R—Fe—B sintered magnet:

$$\beta=-0.7308+0.0092\times(Hcj_{RT}) \quad (2)$$

wherein $Hcj_{RT}$ is a coercivity at RT, preferably higher than the value of formula (2) by at least 0.005 percentage point/° C., more preferably at least 0.01 percentage point/° C., and even more preferably at least 0.02 percentage point/° C. According to the invention, there is also available an R—Fe—B sintered magnet having a coercivity at 140° C. ($Hcj_{140}$) which is higher than the value which is computed from the formula (3):

$$Hcj_{140}=Hcj_{RT}\times(1+\Delta T\times\beta/100) \quad (3)$$

wherein $Hcj_{RT}$ is a coercivity at RT, ΔT is a variation of temperature from RT to 140° C., and β is a temperature coefficient computed from formula (2), preferably higher than the value of formula (3) by at least 100 Oe (7.96 kA/m), more preferably at least 150 Oe (11.9 kA/m), and even more preferably at least 200 Oe (15.9 kA/m).

The structure of the magnet contains an intermetallic compound $R_2(Fe,(Co))_{14}B$ as a main phase and R—Fe(Co)-$M_1$ phase as a grain boundary phase. It is noted that $R_2(Fe,(Co))_{14}B$ may include $R_2Fe_{14}B$ when it does not contain Co and $R_2(Fe,Co)_{14}B$ when it contains Co, and R—Fe(Co)-$M_1$ may include R—Fe-$M_1$ phase when it does not contain Co and R—FeCo—$M_1$ phase when it contains Co. The grain boundary phase may further contain an R-$M_1$ phase, preferably R-$M_1$ phase having an R content of at least 50 at %, an $M_2$ boride phase and the like, and the inclusion of $M_2$ boride phase at grain boundary triple junctions is especially preferred. Further the structure of the magnet may contain as the grain boundary phase an R-rich phase as well as phases of compounds of incidental impurities (introduced during the magnet preparation process) such as R carbide, R oxide, R nitride, R halide, and R oxyhalide. It is preferred that neither $R_2(Fe,(Co))_{17}$ phase nor $R_{1.1}(Fe,(Co))_4B_4$ phase be present over at least grain boundary triple junctions, especially all intergranular grain boundaries and grain boundary triple junctions (overall grain boundary phase).

The R—Fe(Co)-$M_1$ phase is composed of a compound containing only Fe when it does not contain Co and a compound containing Fe and Co when it contains Co, and considered as an intermetallic compound phase having a crystal structure of space group I4/mcm, for example, $R_6(Fe,(Co)_{13}(M_1)$ phase, typically $R_6(Fe,(Co))_{13}Ga$ phase. The R—Fe(Co)-$M_1$ grain boundary phase consists of 25 to 35 at % of R, 2 to 8 at % of $M_1$, up to 8 at % (i.e., 0 at % or from more than 0 at % to 8 at %) of Co, and the balance of Fe. This composition may be quantified by an analytic technique such as electron probe microanalyzer (EPMA). It is generally believed that the R—Fe(Co)-$M_1$ phase is created by peritectic reaction of Fe-containing R—Fe(Co) intermetallic compound such as $R_2Fe_{17}$ phase with R-$M_1$ phase such as $R_5(M_1)_3$ phase (e.g., $R_5Ga_3$ or $R_5Si_3$ phase). Thus, the grain boundary phase may contain R-$M_1$ phase. It is believed that in the invention, R—Fe(Co)-$M_1$ phase such as $R_6(Fe,(Co))_{13}Ga$ or $R_6(Fe,(Co))_{13}Si$ phase is mainly formed from $R_2(Fe,(Co))_{14}B$ intermetallic compound phase as main phase and R-$M_1$ phase such as $R_5(M_1)_3$ phase (e.g., $R_5Ga_3$ or $R_5Si_3$ phase), via the aging treatment to be described later. Elements of plural species may substitute at the site of $M_1$.

The high-temperature stability of R—Fe(Co)-$M_1$ phase varies with the species of $M_1$, and the peritectic point at which R—Fe(Co)-$M_1$ phase forms is different with the species of $M_1$. Specifically, the peritectic point is 640° C. for $M_1$=Cu, 750° C. for $M_1$=Al, 850° C. for $M_1$=Ga, 890° C. for $M_1$=Si, 960° C. for $M_1$=Ge, 890° C. for $M_1$=In, and 1,080° C. for $M_1$=Sn.

In the R—Fe—B base sintered magnet, the R—Fe(Co)-$M_1$ phase contains at least two different phases, preferably at least two phases of different crystallinity, specifically A phase which is crystalline with crystallites having a grain size of at least 10 nm, formed at grain boundary triple junctions, and B phase which is amorphous and/or nanocrystalline with crystallites having a grain size of less than 10 nm, formed at intergranular grain boundaries or intergranular grain boundaries and grain boundary triple junctions. In the R—Fe—B base sintered magnet, the A phase is segregated at grain boundary triple junctions whereas the B phase is distributed at intergranular grain boundaries, but not at grain boundary triple junctions, or distributed at both intergranular grain boundaries and grain boundary triple junctions.

The A phase has a higher peritectic point than the B phase. The A phase preferably contains as the element $M_1$ capable of providing a phase having a relatively high peritectic point, at least one element selected from among Si, Ge, In, Sn and Pb. Since the A phase is not only stable at elevated temperature, but also stable over a wide temperature region, the A phase is created from concurrent progress of peritectic reaction and crystallization of R—Fe(Co)-$M_1$ phase, as a crystalline phase having crystallites with a grain size of at least 10 nm formed therein. It is also believed that the A phase is created by reaction of $R_2(Fe,(Co))_{14}B$ intermetallic compound phase as main phase with R-$M_1$ phase, as described above. This reaction generally takes place at the interface between the main phase and the grain boundary phase during the high-temperature aging treatment to be described later. In this case, since the reaction begins from corners of main phase crystal grains having greater surface free energy, the surface of the main phase changes to a shape having low surface free energy, with the progress of formation of A phase, and accordingly, crystal grains of the main phase assume a generally rounded shape. These rounded main phase grains are effective not only for restraining generation of reverse magnetic domains, but also for suppressing a lowering of coercivity at elevated temperature because the local demagnetizing field near grain boundary triple junctions is reduced. On the other hand, when the grain boundary phase contains R-$M_1$ phase, for example, R-$M_1$ phase not having reacted with the main phase, it is generally believed that the R-$M_1$ phase is present in a crystalline state having crystallites with a grain size of at least 10 nm formed, a nanocrystalline state having crystallites with a grain size of less than 10 nm formed, or an amorphous state, depending on the species of Ma, and typically that the R-$M_1$ phase is present in a crystalline state having crystallites with a grain size of at least 10 nm formed, or as a mixture of a nanocrystalline state having crystallites with a grain size of less than 10 nm formed and an amorphous state.

On the other hand, the B phase has a lower peritectic point than the A phase. Thus the B phase has a different composition from the A phase. As used herein, the term "different composition" encompasses a case wherein the species of $M_1$ contained in the two phases is different (either partially or entirely different), and a case wherein the content of an individual element is different (a case wherein the two phases contain a common element in different contents, and a case wherein a particular element is contained in one phase, but not in the other phase). Since the B phase is insufficiently crystallized due to a low peritectic point, it is present as an amorphous phase and/or nanocrystalline phase having crystallites with a grain size of less than 10 nm, formed at intergranular grain boundaries or intergranular grain boundaries and grain boundary triple junctions.

In an appropriate combination of the A phase having a higher peritectic point than the B phase with the 13 phase having a lower peritectic point than the A phase, preferably the A phase contains $M_1$ consisting of at least 20 at %, especially at least 25 at % and up to 80 at %, especially up to 75 at % of at least one element selected from among Si, Ge, In, Sn and Pb, and the balance of at least one element selected from among Al, Mn, Ni, Cu, Zn, Ga, Pd, Ag, Cd, Sb, Pt, Au, Hg and Bi, and the B phase contains $M_1$ consisting of more than 80 at %, especially at least 85 at % of at least one element selected from among Si, Al, Ga, Ag and Cu, and the balance of at least one element selected from among Mn, Ni, Zn, Ge, Pd, Cd, In, Sn, Sb, Pt, Au, Hg, Pb and Bi.

In the R—Fe—B base sintered magnet, the grain boundary phase contains the R—Fe(Co)-$M_1$ phase containing A phase and B phase, preferably the R—Fe(Co)-$M_1$ phase and R-$M_1$ phase, and these phases are preferably distributed such as to surround individual crystal grains of the main phase at intergranular grain boundaries and grain boundary triple junctions. More preferably, individual crystal grains of the main phase each are separated from adjacent crystal grains of the main phase by the grain boundary phase containing the R—Fe(Co)-$M_1$ phase containing A phase and B phase, preferably the R—Fe(Co)-$M_1$ phase and R-$M_1$ phase. For example, with a focus on individual crystal grains of the main phase, a structure in which a main phase grain serves as core and the grain boundary phase encloses the main phase grain as shell (i.e., structure similar to the so-called core/shell structure) is preferred. With this structure, adjacent main phase grains are magnetically divided, leading to a further improvement in coercivity. To insure magnetic division between main phase grains, the narrowest portion of the grain boundary phase interposed between two adjacent main phase grains preferably has a thickness of at least 10 nm, especially at least 20 nm; and the narrowest portion of the grain boundary phase interposed between two adjacent main phase grains preferably has an average thickness of at least 50 nm, especially at least 60 nm.

Where the grain boundary phase contains the R—Fe(Co)-$M_1$ phase containing A phase and B phase, and R-$M_1$ phase, the R-$M_1$ phase contains a reactant phase for reacting with the $R_2(Fe,(Co))_{14}B$ phase as the main phase to form an R—Fe(Co)-$M_1$ phase and a by-product phase produced by the reaction. Since the R-$M_1$ phase is composed of a compound having a relatively low melting point, heat treatment at low temperature causes the R-$M_1$ phase to effectively cover the main phase, contributing to an improvement in coercivity.

Now the method for preparing an R—Fe—B base sintered magnet having the above-defined structure is described. The method for preparing the R—Fe—B base sintered magnet involves several steps which are generally the same as in ordinary powder metallurgy methods. Specifically, the method involves the step of providing an alloy fine powder having a predetermined composition (including melting feed materials to form a source alloy and grinding the source alloy), the step of compression shaping the alloy fine powder in an applied magnetic field into a compact, the step of sintering the compact into a sintered body, and the step of heat treatment to form the specific structure in the magnet.

The step of providing an alloy fine powder having a predetermined composition includes melting feed materials to form a source alloy and grinding the source alloy. In the melting step, feed materials including metals and alloys are weighed so as to meet the predetermined composition, for example, a composition consisting essentially of 12 to 17 at % of R which is at least two of yttrium and rare earth elements and essentially contains Nd and Pr, 0.1 to 3 at % of $M_1$ which is at least two elements selected from among Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from among Ti, V, Cr, Zr, Nb, Mo, Hf, Ta, and W, 4.5+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, typically free of carbon, oxygen and nitrogen. The feed materials are melted in vacuum or an inert gas atmosphere, preferably inert gas atmosphere, typically argon atmosphere, by high-frequency induction heating, cast and cooled into a source alloy. For casting of source alloy, either standard melt casting method or strip casting method may be used.

The step of grinding the source alloy includes coarse grinding such as mechanical crushing or hydrogen decrepitation to an average particle size of at least 0.05 mm and up to 3 mm, especially up to 1.5 mm, and fine milling such as jet milling into an alloy fine powder having an average particle size of at least 0.2 μm, especially at least 0.5 μm and up to 30 μm, especially up to 20 μm. If desired, a lubricant or another additive may be added in one or both of coarse grinding and fine milling steps.

Also applicable to the preparation of the alloy powder is a so-called two-alloy process involving separately preparing a mother alloy approximate to the $R_2$-$T_{14}$-$B_1$ composition (wherein T is Fe or Fe and Co) and a rare earth-rich alloy serving as sintering aid, crushing, weighing and mixing the mother alloy and sintering aid, and milling the mixed powder. The sintering aid alloy may be prepared by the casting technique mentioned above or melt-spun technique.

In the shaping step using a compression shaping machine, the alloy fine powder is compression shaped into a compact under an applied magnetic field, for example, of 5 kOe (398 kA/m) to 20 kOe (1,592 kA/m), for orienting the axis of easy magnetization of alloy particles. The shaping is preferably performed in vacuum or inert gas atmosphere, especially nitrogen gas atmosphere, to prevent alloy particles from oxidation. The compact is then sintered into a sintered body. The sintering step is preferably at a temperature of at least 900° C., especially at least 1,000° C. and up to 1,250° C., especially up to 1,150° C., typically for a time of 0.5 to 5 hours.

This is followed by heat treatment in which the heating temperature is controlled so as to form the specific structure in the magnet. The heat treatment step includes two stages of aging treatment:

high-temperature aging treatment (a) including cooling the sintered body to a temperature of 400° C. or below, heating the sintered body at a temperature in the range of 700 to 1,000° C., and cooling again to a temperature of 400° C. or below at a rate of 5 to 100° C./min, or high-temperature aging treatment (b) including lowering, holding or elevating the temperature of the sintered body for thereby heating it at a temperature in the range of 700 to 1,000° C., and cooling to a temperature of 400° C. or below at a rate of 5 to 100° C./min, and low-temperature aging treatment including heating the sintered body, after the high-temperature aging treatment, at a temperature in the range of 400 to 600° C. and cooling to a temperature of 200° C. or below. The heat treatment is preferably performed in vacuum or inert gas atmosphere, preferably inert gas atmosphere, typically argon atmosphere.

In the high-temperature aging treatment (a), the sintered body is cooled to a temperature of 400° C. or below. The cooling rate, though not particularly limited, is preferably 5 to 100° C./min, more preferably 5 to 50° C./min. After cooling to a temperature of 400° C. or below, the sintered body is heated at a temperature in the range of 700 to 1,000° C. If the heating temperature is below 700° C., not only the A phase, but also the B phase precipitates at grain boundary triple junctions, and crystallization proceeds further, resulting in a substantial degradation of coercivity at RT. If the temperature exceeds 1,000° C., the main phase promotes growth of grains and undesirably growth of abnormal grains. Advantageously the heating temperature is not higher than the peritectic point of A phase. Further preferably the heating temperature is equal to or higher than the peritectic point of B phase. While the peritectic point varies with the species of $M_1$, the peritectic point of the element of $M_1$ elements providing the highest peritectic point is set as the peritectic point of A phase, and the peritectic point of the element of $M_1$ elements providing the lowest peritectic point is set as the peritectic point of B phase. The heating rate during high-temperature aging treatment, though not particularly limited, is preferably set at least 1° C./min, more preferably at least 2° C./min and up to 20° C./min, more preferably up to 10° C./min in order to mitigate the occurrence of heat shock cracks in the sintered body.

In the high-temperature aging treatment, either one or both of the step of cooling after sintering and the step of heating to the heating temperature may be omitted. In this case, the high-temperature aging treatment (b) includes lowering, holding or elevating the temperature of the sintered body for thereby heating it at a temperature in the range of 700 to 1,000° C. and cooling to a temperature of 400° C. or below at a rate of 5 to 100° C./min. In the step of lowering the temperature of the sintered body, the sintered body may be cooled from the sintering temperature to the heating temperature for the high-temperature aging treatment, typically at a rate of 5 to 100° C./min, especially 5 to 50° C./min. When the step of holding the temperature of the sintered body is taken, both the step of cooling after sintering and the step of heating to the heating temperature are omitted. In the step of elevating the temperature of the sintered body, the sintered body may be heated at a rate of at least 1° C./min, more preferably at least 2° C./min and up to 20° C./min, more preferably up to 10° C./min in order to mitigate the occurrence of heat shock cracks in the sintered body. This embodiment wherein either one or both of the step of cooling after sintering and the step of heating to the heating temperature are omitted is advantageous particularly when heat shock cracks are likely to occur upon cooling or heating, for example, the sintered body is of large size.

The holding time at the high-temperature aging treatment temperature is preferably at least 1 hour, and typically up to 10 hours, preferably up to 5 hours. At the end of heating, the sintered body is cooled to a temperature of 400° C. or below, preferably 300° C. or below. The cooling rate is preferably at least 5° C./min, and up to 100° C./min, more preferably up to 80° C./min, especially up to 50° C./min. If the cooling rate is less than 5° C./min, not only the A phase, but also the B phase precipitates at grain boundary triple junctions, exacerbating magnetic properties noticeably. If the cooling rate exceeds 100° C./min, the precipitation of B phase during this cooling step is suppressed, but the dispersion of R—Fe(Co)-$M_1$ phase, or R—Fe(Co)-$M_1$ phase and R-$M_1$ phase, if R—Fe(Co)-$M_1$ phase and R-$M_1$ phase are contained, in the structure becomes insufficient, resulting in the sintered magnet with degraded squareness. The high-temperature aging treatment described above ensures that the A phase forms as segregated at grain boundary triple junctions in the grain boundary phase. When the A phase is not formed by the high-temperature aging treatment, it is possible to form a crystallized R—Fe(Co)-$M_1$ phase at grain boundary triple junctions by elevating the temperature of the low-temperature aging treatment or extending the heating time. In this case, the coercivity at high temperature is increased, whereas the phase of intergranular grain boundary becomes discontinuous, leading to a lowering of coercivity at RT. For gaining high coercivity both at RT and high temperature, it is effective that the A phase is formed at grain boundary triple junctions during the high-temperature aging treatment.

In the low-temperature aging treatment following the high-temperature aging treatment, the sintered body which has been cooled to a temperature of 400° C. or below is heated at a temperature of at least 400° C., preferably at least 450° C. and up to 600° C., preferably up to 550° C. If the heating temperature is lower than 400° C., the rate of reaction to form the B phase is substantially retarded. If the temperature exceeds 600° C., the B phase forming rate is increased and crystallization reaction is promoted, whereby the B phase segregates at grain boundary triple junctions, substantially exacerbating magnetic properties. Preferably the heating temperature is not higher than the peritectic point of B phase. While the peritectic point varies with the species of $M_1$, the peritectic point of the element of $M_1$ elements providing the lowest peritectic point may be set as the peritectic point of B phase.

The heating rate during low-temperature aging treatment, though not particularly limited, is preferably set at least 1° C./min, more preferably at least 2° C./min and up to 20° C./min, more preferably up to 10° C./min in order to mitigate the occurrence of heat shock cracks in the sintered body. The holding time after heating in the low-temperature aging treatment is preferably at least 0.5 hour, more preferably at least 1 hour, and up to 50 hours, more preferably up to 20 hours. At the end of heating, the sintered body is cooled to a temperature of 200° C. or below, typically RT. The cooling rate is preferably at least 5° C./min, and up to 100° C./min, more preferably up to 80° C./min, and even more preferably up to 50° C./min. Through the low-temperature aging treatment, the B phase is formed in the grain boundary phase as being distributed at intergranular grain boundaries, but not at grain boundary triple junctions, or at both intergranular grain boundaries and grain boundary triple junctions.

Various parameters in the high- and low-temperature aging treatments may be adjusted as appropriate in their ranges defined above, depending on variations associated with the preparation process excluding the high- and low-temperature aging treatments, for example, the species and content of element $M_1$, the concentration of impurities, especially impurities introduced from the atmosphere gas during the preparation process, and sintering conditions.

EXAMPLE

Examples are given below for further illustrating the invention although the invention is not limited thereto.

Examples 1 to 4 & Comparative Examples 1 to 4

A ribbon form alloy was prepared by the strip casting technique, specifically by using single Nd metal and didymium (mixture of Nd and Pr) as rare earth element R, electrolytic iron, cobalt, two or more single metals selected from Al, Cu, Si, Ga and Sn as element $M_1$, Zr metal as element $M_2$, and ferroboron (Fe—B alloy), weighing them so as to meet the desired composition shown in Table 1, melting the mix in an Ar atmosphere on a high-frequency induction furnace, and strip casting the melt onto a water-cooled copper chill roll. The ribbon form alloy had a thickness of about 0.2 to 0.3 mm.

TABLE 1

| at % | | Nd | Pr | Fe | Co | B | Al | Cu | Zr | Si | Ga | Sn |
|---|---|---|---|---|---|---|---|---|---|---|---|---|
| Example | 1 | 11.6 | 3.4 | bal. | 0.5 | 5.4 | 0.2 | 0.7 | 0.07 | 0.1 | 0.7 | 0.1 |
| | 2 | 11.6 | 3.4 | bal. | 0.5 | 5.4 | 0.2 | 0.7 | 0.07 | 0.1 | 0.7 | 0.1 |
| | 3 | 11.6 | 3.4 | bal. | 0.5 | 5.4 | 0.2 | 0.5 | 0.07 | 0.3 | 0.5 | |
| | 4 | 11.6 | 3.4 | bal. | 0.5 | 5.4 | 0.2 | 0.5 | 0.07 | 0.5 | 0.3 | |
| Comparative Example | 1 | 11.6 | 3.4 | bal. | 0.5 | 5.4 | 0.2 | 0.7 | 0.07 | | 0.8 | |
| | 2 | 11.6 | 3.4 | bal. | 0.5 | 6.2 | 0.5 | 0.2 | 0.07 | 0.1 | 0.1 | |
| | 3 | 11.2 | 3.3 | bal. | 1.0 | 5.5 | 0.5 | 0.4 | 0.07 | | 0.2 | 0.2 |
| | 4 | 11.6 | 3.4 | bal. | 0.5 | 5.4 | 0.2 | 0.5 | 0.07 | 0.5 | 0.3 | |

The alloy was subjected to hydrogen decrepitation, that is, hydrogen absorption at normal temperature and subsequent heating at 600° C. in vacuum for hydrogen desorption. To the resulting alloy powder, 0.07 wt % of stearic acid as lubricant was added and mixed. The coarse powder was finely milled on a jet mill using nitrogen stream, into a fine powder having an average particle size of 2.9 μm.

In a nitrogen gas atmosphere, a mold of a compacting machine was charged with the powder. While a magnetic field of 15 kOe (1.19 MA/m) was applied for orientation, the powder was compression molded in a direction perpendicular to the magnetic field. The compact was sintered in vacuum at 1,050-1,100° C. for 3 hours. The sintered body was subjected to high-temperature aging treatment under the conditions shown in Table 2 and then to low-temperature aging treatment under the conditions shown in Table 3.

TABLE 2

| | | Cooling | | Heating | | | Re-cooling | | Peritectic point |
|---|---|---|---|---|---|---|---|---|---|
| | | Rate (° C./min) | Temp. (° C.) | Rate (° C./min) | Temp. (° C.) | Time (hr) | Rate (° C./min) | Temp. (° C.) | A phase (° C.) |
| Example | 1 | 25 | 100 | 5 | 900 | 2 | 25 | 100 | 1,080 |
| | 2 | 25 | 100 | 5 | 900 | 2 | 25 | 100 | 1,080 |
| | 3 | 25 | 100 | 5 | 750 | 2 | 25 | 100 | 890 |
| | 4 | 25 | 100 | 5 | 750 | 2 | 25 | 100 | 890 |
| Comparative Example | 1 | 25 | 100 | 5 | 900 | 2 | 25 | 100 | 850 |
| | 2 | 25 | 100 | 5 | 900 | 2 | 25 | 100 | 890 |
| | 3 | 25 | 100 | 5 | 900 | 2 | 25 | 100 | 1,080 |
| | 4 | 25 | 100 | 5 | 950 | 2 | 25 | 100 | 890 |

TABLE 3

| | | Heating | | | Cooling | |
|---|---|---|---|---|---|---|
| | | Rate (° C./min) | Temp. (° C.) | Time (hr) | Rate (° C./min) | Temp. (° C.) |
| Example | 1 | 5 | 460 | 6 | 25 | 100 |
| | 2 | 5 | 500 | 6 | 25 | 100 |
| | 3 | 5 | 450 | 2 | 25 | 100 |
| | 4 | 5 | 450 | 2 | 25 | 100 |
| Comparative Example | 1 | 5 | 460 | 6 | 25 | 100 |
| | 2 | 5 | 500 | 6 | 25 | 100 |
| | 3 | 5 | 360 | 6 | 25 | 100 |
| | 4 | 5 | 450 | 2 | 25 | 100 |

Figure 2:
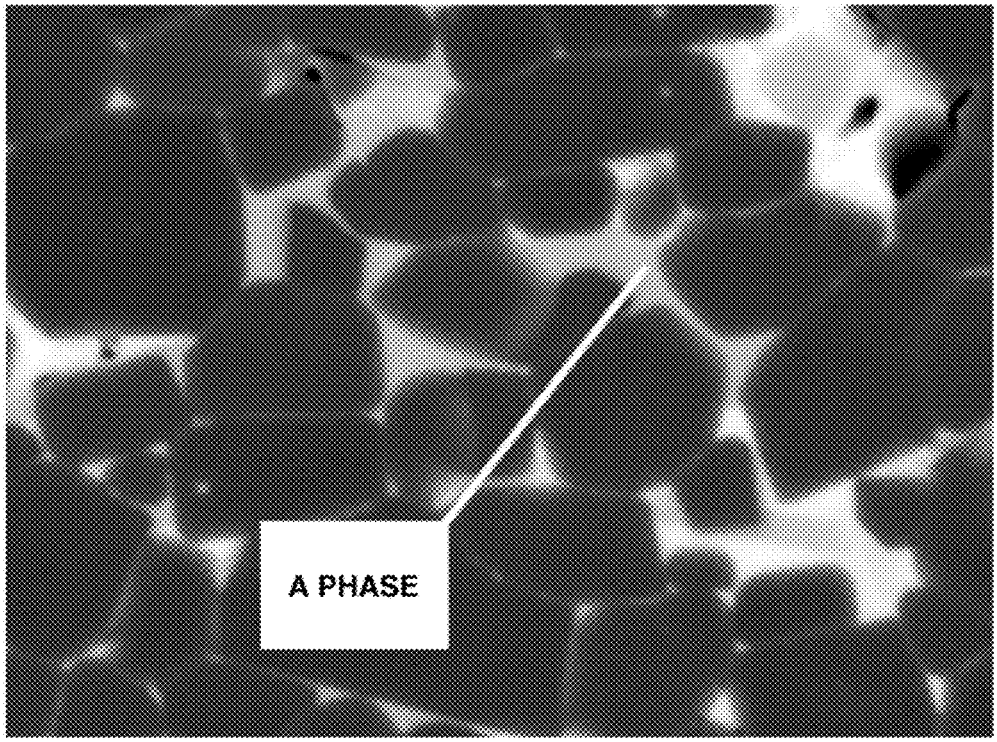
FIG. 2 is an electron micrograph in cross section of a magnet after high-temperature aging treatment in Example 1.
Figure 3:
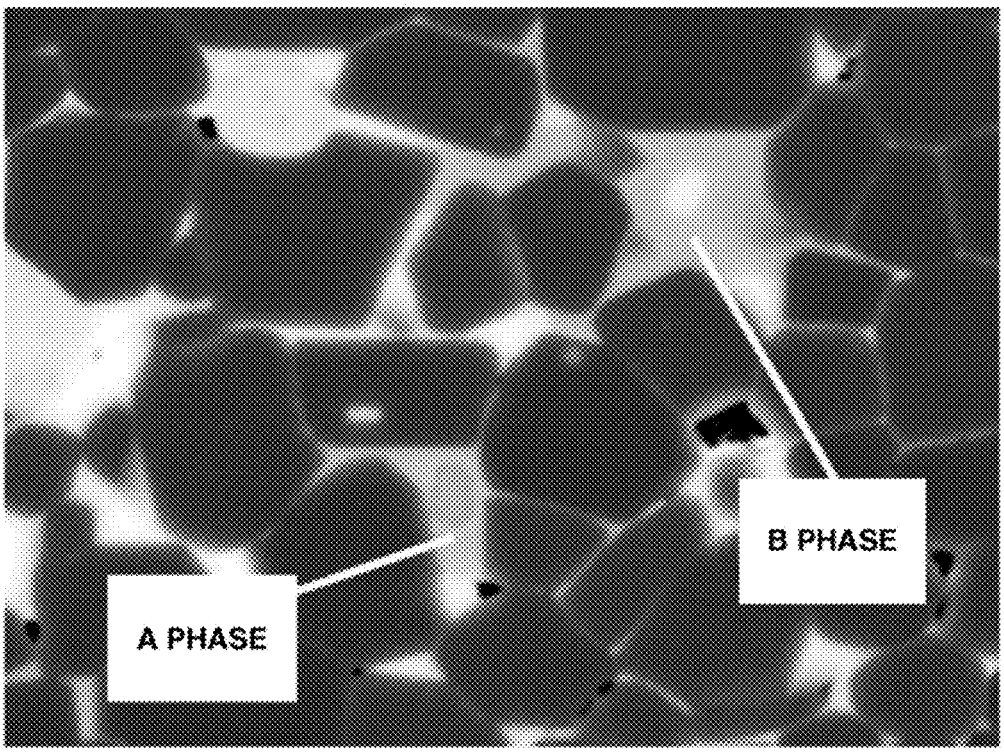
FIG. 3 is an electron micrograph in cross section of a magnet after low-temperature aging treatment in Example 1.
Figure 4:
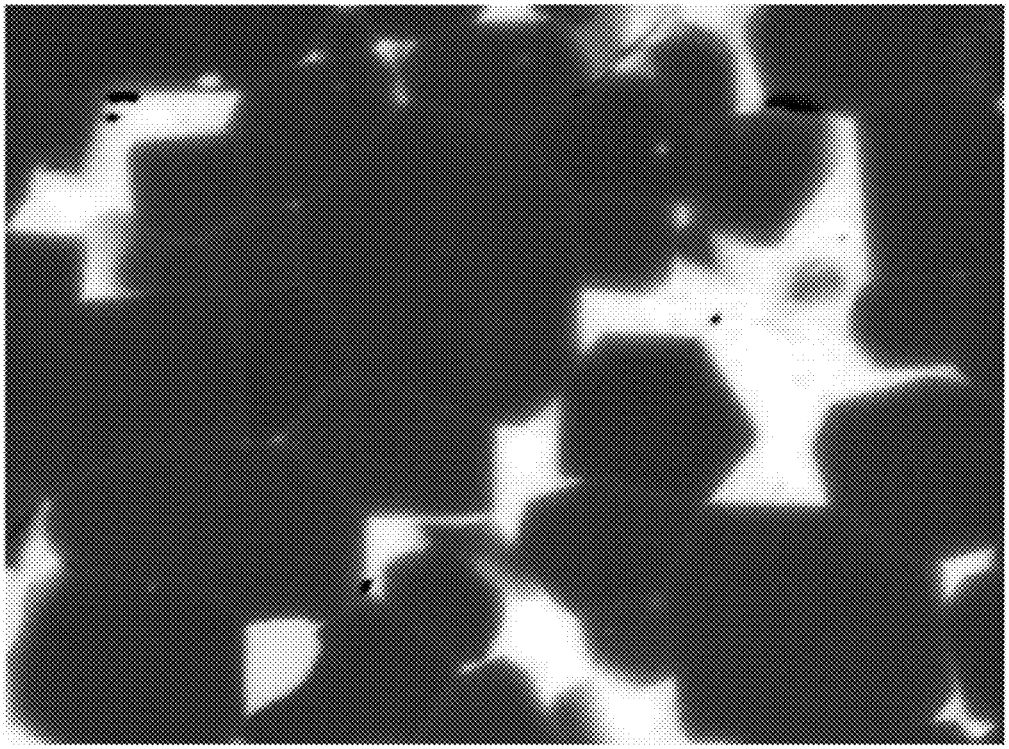
FIG. 4 is an electron micrograph in cross section of a magnet after high-temperature aging treatment in Comparative Example 1.

For the magnets of Examples 1 to 4 and Comparative Examples 1 to 4, Table 4 reports the remanence (Br) and coercivity (Hcj) at RT (~23° C.), coercivity (Hcj) at 140° C., and temperature coefficient of coercivity (Hcj), Table 5 reports the average minimum thickness of a portion of the grain boundary phase interposed between two adjacent main phase grains (or average thickness of grain boundary phase between two grains), the state of R—Fe(Co)-$M_1$ phase (whether or not A phase and B phase are present), and whether or not $M_2$ boride phase and B-rich phase ($R_{1.1}Fe_4B_4$ phase) are present. FIG. 1 is a diagram showing coercivity values at RT and 140° C. of the magnets of Examples 1 to 4 and Comparative Examples 1 to 4. FIG. 2 is an electron micrograph (backscattered electron image) in cross section of the magnet after high-temperature aging treatment in Example 1. FIG. 3 is an electron micrograph in cross section of the magnet after low-temperature aging treatment in Example 1. FIG. 4 is an electron micrograph in cross section of the magnet after high-temperature aging treatment in Comparative Example 1.

TABLE 4

| | | Br at RT (kG) | Hcj at RT (kOe) | Hcj at 140° C. (kOe) | Temperature coefficient of Hcj (%/° C.) |
|---|---|---|---|---|---|
| Example | 1 | 13.25 | 19.0 | 6.9 | −0.544 |
| | 2 | 13.20 | 18.5 | 6.9 | −0.536 |
| | 3 | 13.20 | 20.5 | 7.8 | −0.529 |
| | 4 | 13.15 | 20.5 | 7.8 | −0.529 |
| Comparative Example | 1 | 13.45 | 19.0 | 5.8 | −0.594 |
| | 2 | 13.70 | 16.5 | 4.8 | −0.606 |
| | 3 | 13.50 | 14.0 | 3.9 | −0.617 |
| | 4 | 13.40 | 20.0 | 6.5 | −0.577 |

TABLE 5

| | | Average thickness of interganular grain boundary | R—Fe(Co)—$M_1$ phase | | $M_2$ boride | $R_{1.1}Fe_4B_4$ |
|---|---|---|---|---|---|---|
| | | (nm) | A phase | B phase | phase | phase |
| Example | 1 | 250 | found at grain boundary triple junctions | found at intergranular grain boundaries and grain boundary triple junctions | $ZrB_2$ at grain boundary triple junctions | not found |
| | 2 | 230 | found at grain boundary triple junctions | found at intergranular grain boundaries and grain boundary triple junctions | $ZrB_2$ at grain boundary triple junctions | not found |
| | 3 | 230 | found at grain boundary triple junctions | found at intergranular grain boundaries and grain boundary triple junctions | $ZrB_2$ at grain boundary triple junctions | not found |

TABLE 5-continued

| | | Average thickness of interganular grain boundary (nm) | R—Fe(Co)—$M_1$ phase A phase | R—Fe(Co)—$M_1$ phase B phase | $M_2$ boride phase | $R_{1.1}Fe_4B_4$ phase |
|---|---|---|---|---|---|---|
| | 4 | 230 | found at grain boundary triple junctions | found at intergranular grain boundaries and grain boundary triple junctions | $ZrB_2$ at grain boundary triple junctions | not found |
| Comparative Example | 1 | 200 | not found | found at intergranular grain boundaries and grain boundary triple junctions | $ZrB_2$ at grain boundary triple junctions | not found |
| | 2 | <10 | not found | not found | $ZrB_2$ at grain boundary triple junctions | found in grain boundary phase |
| | 3 | <50 | found at grain boundary triple junctions | not found | $ZrB_2$ at grain boundary triple junctions | not found |
| | 4 | 200 | not found | found at intergranular grain boundaries and gain boundary triple junctions | $ZrB_2$ at grain boundary triple junctions | not found |

In the diagram of FIG. 1, the broken line shows the relationship of a coercivity at RT to a coercivity at 140° C. of a conventional R—Fe—B base sintered magnet, which is represented by the formula (3-1):

$$Hcj_{140}=Hcj_{RT}\times(1+\Delta T\times\beta/100) \quad (3\text{-}1)$$

wherein $Hcj_{140}$ is a coercivity at 140° C., $Hcj_{RT}$ is a coercivity at RT, ΔT is a variation of temperature from RT to 140° C., and β is a temperature coefficient computed from the above formula (2). The magnets of Examples 1 to 4 exhibit high coercivity values both at RT and 140° C. and a satisfactory temperature coefficient of coercivity. The magnets of Comparative Examples 1 and 4 exhibit equivalent coercivity values at RT to those of Examples 1 to 4, but low coercivity values at 140° C. The magnets of Comparative Examples 2 and 3 exhibit low coercivity values at RT and 140° C. The magnets of Comparative Examples 1 to 4 have more negative values of temperature coefficient of coercivity.

In Examples 1 and 2 wherein the $M_1$ element having the highest peritectic point is Sn, high-temperature aging treatment was performed at 900° C. which is lower than the peritectic point. As seen from FIG. 2, after the high-temperature aging treatment, A phase was created and segregated at grain boundary triple junctions. Also as seen from FIG. 3, after the low-temperature aging treatment, two phases, A phase and B phase were found in the grain boundary phase, demonstrating that B phase was created at both intergranular grain boundaries and grain boundary triple junctions, With respect to the shape of main phase grains at grain boundary triple junctions, it is seen from FIGS. 2 and 3 that the corner of main phase grains near the thus created A phase is rounded as a result of edges being blunted. Table 6 tabulates the results of semi-quantitative analysis of A phase and B phase in the cross-sectional structure shown in FIG. 3.

TABLE 6

| at % | Nd | Pr | Fe | Co | Cu | Si | Ga | Sn |
|---|---|---|---|---|---|---|---|---|
| A phase | 19.7 | 6.0 | 66.3 | 0.2 | 0.4 | 0.2 | 4.3 | 2.9 |
| B phase | 22.0 | 6.2 | 65.3 | 0 | 0.2 | 0.1 | 6.2 | 0 |

It is seen from these data that A phase contains 2.9 at % of Sn, but B phase does not contain Sn at all. It was also confirmed from diffraction pattern analysis under TEM that in either of Examples 1 and 2, A phase was a crystalline phase having crystallites of at least 10 nm formed and B phase was an amorphous phase or a nanocrystalline phase having crystallites of less than 10 nm formed.

In Examples 3 and 4 wherein the $M_1$ element having the highest peritectic point is Si, high-temperature aging treatment was performed at 750° C. which is lower than the peritectic point. Like Examples 1 and 2, after the high-temperature aging treatment, A phase was created and segregated at grain boundary triple junctions; and after the low-temperature aging treatment, two phases, A phase and B phase were found in the grain boundary phase, demonstrating that B phase was created at both intergranular grain boundaries and grain boundary triple junctions. Table 7 tabulates the results of semi-quantitative analysis of A phase and B phase in the cross-sectional structure of Example 4. It is seen from these data that Si having a high peritectic point is enriched in A phase.

TABLE 7

| at % | Nd | Pr | Fe | Co | Cu | Si | Ga |
|---|---|---|---|---|---|---|---|
| A phase | 21.3 | 8.3 | 62.5 | 0.1 | 0.2 | 4.0 | 3.6 |
| B phase | 22.5 | 8.1 | 61.9 | 0 | 0.3 | 3.0 | 4.2 |

In Comparative Example 1 wherein the $M_1$ element having the highest peritectic point is Ga, high-temperature aging treatment was performed at 900° C. which is higher than the peritectic point. As seen from FIG. 4, after the high-temperature aging treatment, no R—Fe(Co)-$M_1$ phase (A phase) was created. With respect to the shape of main phase grains at grain boundary triple junctions, it is seen from FIG. 4 that main phase grains have angular edges. In Comparative Example 2 wherein the boron content is higher than the specific range, the boron-rich phase precipitated in the grain boundary phase and no R—Fe(Co)-$M_1$ phase (A phase and B phase) was created.

In Comparative Example 3 wherein the $M_1$ element having the highest peritectic point is Sn, high-temperature aging treatment was performed at 900° C. which is lower than the peritectic point of A phase. After the high-temperature aging treatment, A phase was created at grain boundary triple junctions. Since low-temperature aging treatment was performed at a low temperature of 360° C., R—Fe(Co)-$M_1$ phase (B phase) was insufficiently formed at the end of low-temperature aging treatment. In Comparative Example 4 wherein the $M_1$ element having the highest peritectic point is Si, high-temperature aging treatment was performed at 950° C. which is higher than the peritectic point. After the high-temperature aging treatment, no R—Fe(Co)-$M_1$ phase (A phase) was created. Only R—Fe(Co)-$M_1$ phase (B phase) was formed at the end of low-temperature aging treatment.

Japanese Patent Application No, 2016-121539 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An R—Fe—B base sintered magnet of a composition consisting essentially of 12 to 17 at % of R which contains Nd and Pr, and optionally contains one or more elements selected from the group consisting of yttrium and rare earth elements other than Nd and Pr, 0.1 to 3 at % of $M_1$ which is at least two elements selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.5+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, and containing an intermetallic compound $R_2(Fe,(Co))_{14}B$ as a main phase, wherein the magnet contains an R—Fe(Co)-$M_1$ phase consisting essentially of 25 to 35 at % of R, 2 to 8 at % of $M_1$, up to 8 at % of Co, and the balance of Fe as a grain boundary phase, the R—Fe(Co)-$M_1$ phase contains an A phase which is crystalline with crystallites having a grain size of at least 10 nm formed at grain boundary triple junctions, and a B phase which is amorphous and/or nanocrystalline with crystallites having a grain size of less than 10 nm formed at intergranular grain boundaries or intergranular grain boundaries and grain boundary triple junctions, the B phase having a different composition from the A phase, in the A phase, $M_1$ consists of 20 to 80 at % of at least one element selected from the group consisting of Si, Ge, In, Sn, and Pb and the balance of at least one element selected from the group consisting of Al, Mn, Ni, Cu, Zn, Ga, Pd, Ag, Cd, Sb, Pt, Au, Hg and Bi, in the B phase, $M_1$ consists of more than 80 at % of at least one element selected from the group consisting of Si, Al, Ga, Ag, and Cu and the balance of at least one element selected from the group consisting of Mn, Ni, Zn, Ge, Pd, Cd, In, Sn, Sb, Pt, Au, Hg, Pb and Bi, and the magnet does not contain an $R_{1.1}Fe_4B_4$ compound phase, the narrowest portion of the grain boundary phase interposed between two adjacent crystal grains of the main phase has an average thickness of at least 50 nm.

2. The sintered magnet of claim 1 wherein a total content of Dy, Tb and Ho is up to 5 at % of the total of R.

3. The sintered magnet of claim 1 wherein the grain boundary phase containing the R—Fe(Co)-$M_1$ phase containing the A phase and B phase is distributed such as to surround individual crystal grains of the main phase at intergranular grain boundaries and grain boundary triple junctions.

4. A method for preparing the R—Fe—B base sintered magnet of claim 1, comprising the steps of:

providing an alloy fine powder having a predetermined composition, compression shaping the alloy fine powder in an applied magnetic field into a compact, sintering the compact at a temperature of 900 to 1,250° C. into a sintered body, high-temperature aging treatment including cooling the sintered body to a temperature of 400° C. or below, heating the sintered body at a temperature in the range of 700 to 1,000° C. and not higher than the peritectic point of the A phase, and cooling again to a temperature of 400° C. or below at a rate of 5 to 100° C./min, or high-temperature aging treatment including lowering, holding or elevating the temperature of the sintered body for thereby heating it at a temperature in the range of 700 to 1,000° C. and not higher than the peritectic point of the A phase, and cooling to a temperature of 400° C. or below at a rate of 5 to 100° C./min, and low-temperature aging treatment including heating the sintered body, after the high-temperature aging treatment, at a temperature in the range of 400 to 600° C. and cooling to a temperature of 200° C. or below.

5. The method of claim 4 wherein the A phase is formed at grain boundary triple junctions during the high-temperature aging treatment, and the B phase is formed at intergranular grain boundaries or intergranular grain boundaries and grain boundary triple junctions during the low-temperature aging treatment.

6. The sintered magnet of claim 1 wherein the A phase is segregated at grain boundary triple junctions.

7. The sintered magnet of claim 1 wherein the grain boundary triple junction includes $M_2$ boride phase.

8. The sintered magnet of claim 1 wherein the A phase comprises, as the element $M_1$, at least one element selected from the group consisting of Si, Ge, In, Sn and Pb.

* * * * *